US006153050A

United States Patent [19]

Savoie et al.

[11] Patent Number: 6,153,050

[45] Date of Patent: Nov. 28, 2000

[54] METHOD AND SYSTEM FOR CONTROLLING THE ADDITION OF BLEACHING REAGENTS TO OBTAIN A SUBSTANTIALLY CONSTANT PERCENTAGE OF PULP DELIGNIFICATION ACROSS THE FIRST BLEACHING/DELIGNIFYING STAGE

[75] Inventors: Martin Savoie, Kirkland; Patrick Jean-Claude Tessier, Calgary; Martin William Pudlas, Prince George, all of Canada

[73] Assignee: Noranda Forest Inc., Canada

[21] Appl. No.: 09/046,551

[22] Filed: Mar. 24, 1998

[51] Int. Cl.[7] ..... D21F 7/06

[52] U.S. Cl. ..... 162/49; 162/62; 162/238; 162/DIG. 10

[58] Field of Search ..... 162/49, 88, 89, 162/238, 198, 61, 62, 263

[56] References Cited

U.S. PATENT DOCUMENTS

| | | |
|---|---|---|
| 2,307,137 | 1/1943 | Kennedy . |
| 3,272,691 | 9/1966 | Shera . |
| 3,486,971 | 12/1969 | Weyrick . |

(List continued on next page.)

FOREIGN PATENT DOCUMENTS

| | | |
|---|---|---|
| 1057906 | 7/1979 | Canada . |
| 2537143 | 3/1976 | Germany . |
| 55-40823 | 3/1980 | Japan . |
| 654716 | 3/1979 | U.S.S.R. . |

OTHER PUBLICATIONS

Burnett, "Computer Control of the Chlorine Stage"; Pulp and Paper Magazine of Canada; vol. 71, No. 14, pp. 57–62, Jul. 1970.

"Displacement chlorination of kraft pulps—an experimental study and comparison of models", J.E. Ackert, et al., Oct. 1975; vol. 58, No. 10. "A mathematical model for chlorine dioxide delignification", (see next page).

"A mathematical model for chlorine dioxide delignification", M. Savoie, et al., vol. 80, No. 6 Tappi Journal.

"Chlorine Dioxide Delignification Kinetics and Eop Extraction of Softwood Kraft Pulp", P. Tessier, The Canadian Journal Of Chemical Engineering, vol. 75, Feb. 1997.

"A new kraft pulping analyzer for monitoring organic and inorganic substances", P. Tikka, et al., Tappi Journal, Jun. 1986.

"Bleach plant computer control", H.Danforth, et al., Tappi Journal, Mar. 1975, vol. 58, No. 3.

"Computer Control of the Chlorine Stage", T.C. Burnett, Technical Paper, vol. 71, No. 14, Jul. 17, 1970.

"Computer Applications:Woodlands Through Bleach Plant–II", R. Grant, Paper Trade Journal, Jun. 21, 1971.

"Computer–Controlled Pulping Details Given", C&EN, Nov. 11, 1963.

The STFI OPTI–Kappa analyzer, E. Kubulnieks, et al., Tappi Journal, Nov. 1987.

"Kappa number and overall yield calculation based on digester liquor analysis", M. Paulonis, et al., Tappi Journal, Nov. 1988.

"Computer Applications:Woodlands Through Bleach Plant–I", R. Grant, Paper Trade Journal, Jun. 14, 1871.

"Improved Fiberline Automation Helps Swedish Mill Produce ECF, TCF Pulp", Mar. 1994 Pulp & Paper.

*Primary Examiner*—Steve Alvo

*Attorney, Agent, or Firm*—Fitzpatrick, Cella, Harper & Scinto

[57] ABSTRACT

A method for controlling the addition of bleaching/delignifying reagents to obtain a substantially constant percentage of pulp delignification across the first bleaching stage. The present method allows substantial improvements in bleached pulp quality through proper addition of the bleaching/delignifying reagent flow rate. The efficiency of the bleaching/delignifying reagent is therefore greatly improved. Further, reduction of pulp off-grades, equipment corrosion and effluent loading are additional beneficial effects resulting from the present method.

10 Claims, 2 Drawing Sheets

Performance of Present Control Method

U.S. PATENT DOCUMENTS 3,745,065 7/1973 Bama .
3,754,417 8/1973 Jamieson .
3,962,029 6/1976 Wettermark et al. .
3,968,006 7/1976 Zimmerman .
3,980,517 9/1976 MacTaggart .
4,013,506 3/1977 Histed et al. .
4,104,114 8/1978 Rowlandson et al. .
4,192,708 3/1980 Bergstrom et al. .
4,348,256 9/1982 Bergstrom et al. .
4,540,468 9/1985 Genco et al. .
4,717,672 1/1988 Fleming et al. .
4,735,684 4/1988 Seymour .
4,840,703 6/1989 Malmsten .
4,842,689 6/1989 Jikka et al. .
4,878,998 11/1989 Hook et al. .
4,895,618 1/1990 Tikka et al. .
4,946,555 8/1990 Lee et al. .
4,952,276 8/1990 Gidlund et al. .
5,032,977 7/1991 Beller et al. .
5,229,294 7/1993 Foster .
5,282,931 2/1994 LeClerc et al. .
5,306,391 4/1994 Cirucci et al. .
5,330,621 7/1994 Visuri et al. .
5,366,592 11/1994 Ford .
5,403,441 4/1995 McDonald .
5,527,706 6/1996 Kroneis et al. .
5,540,816 7/1996 Andtbacka et al. .
5,672,247 9/1997 Pangalos et al. ..... 162/238
5,736,004 4/1998 Pangalos et al. ..... 162/49

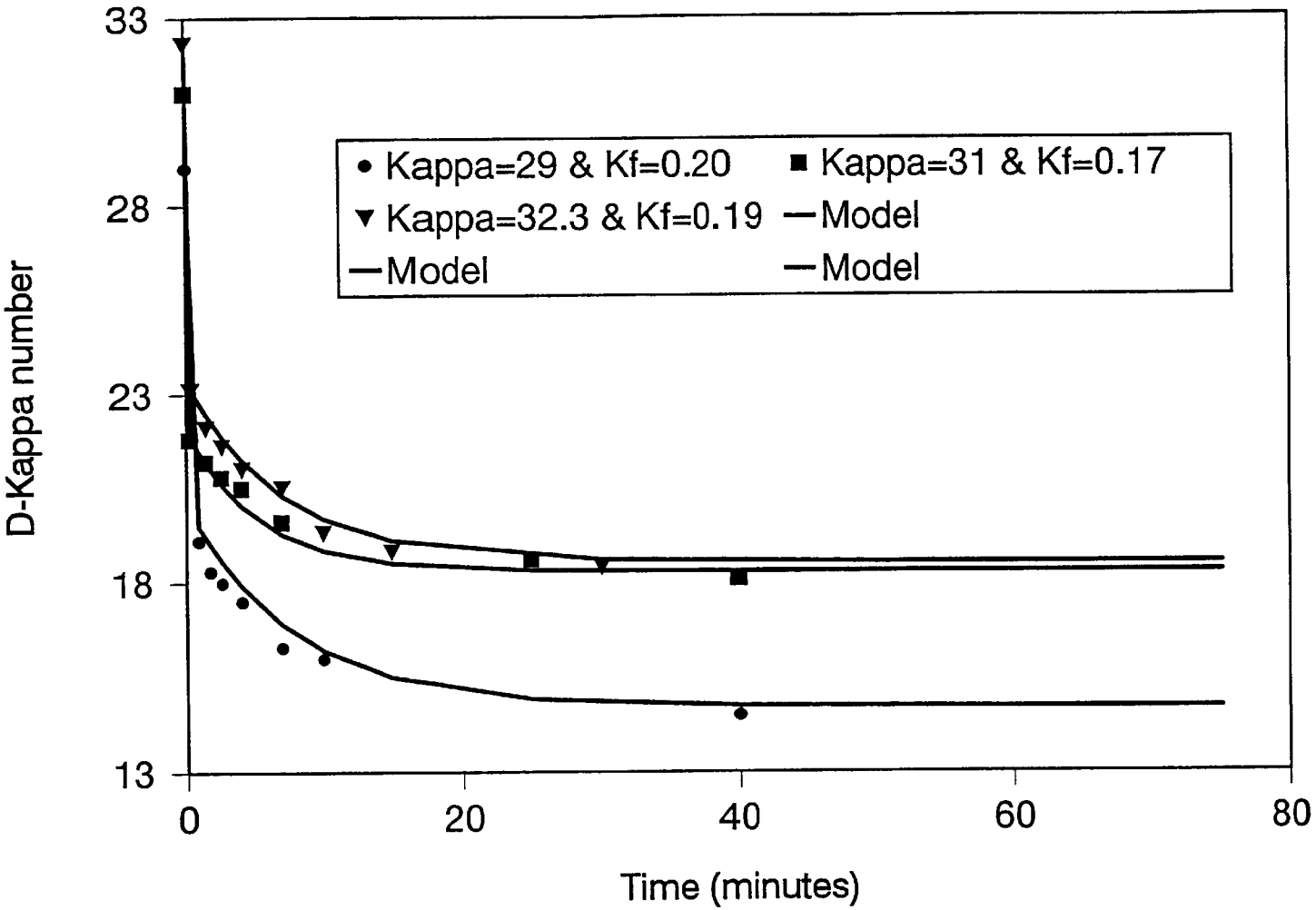
Fig 1: Experimental data versus model predictions at 50 C

Fig 2: Performance of Present Control Method
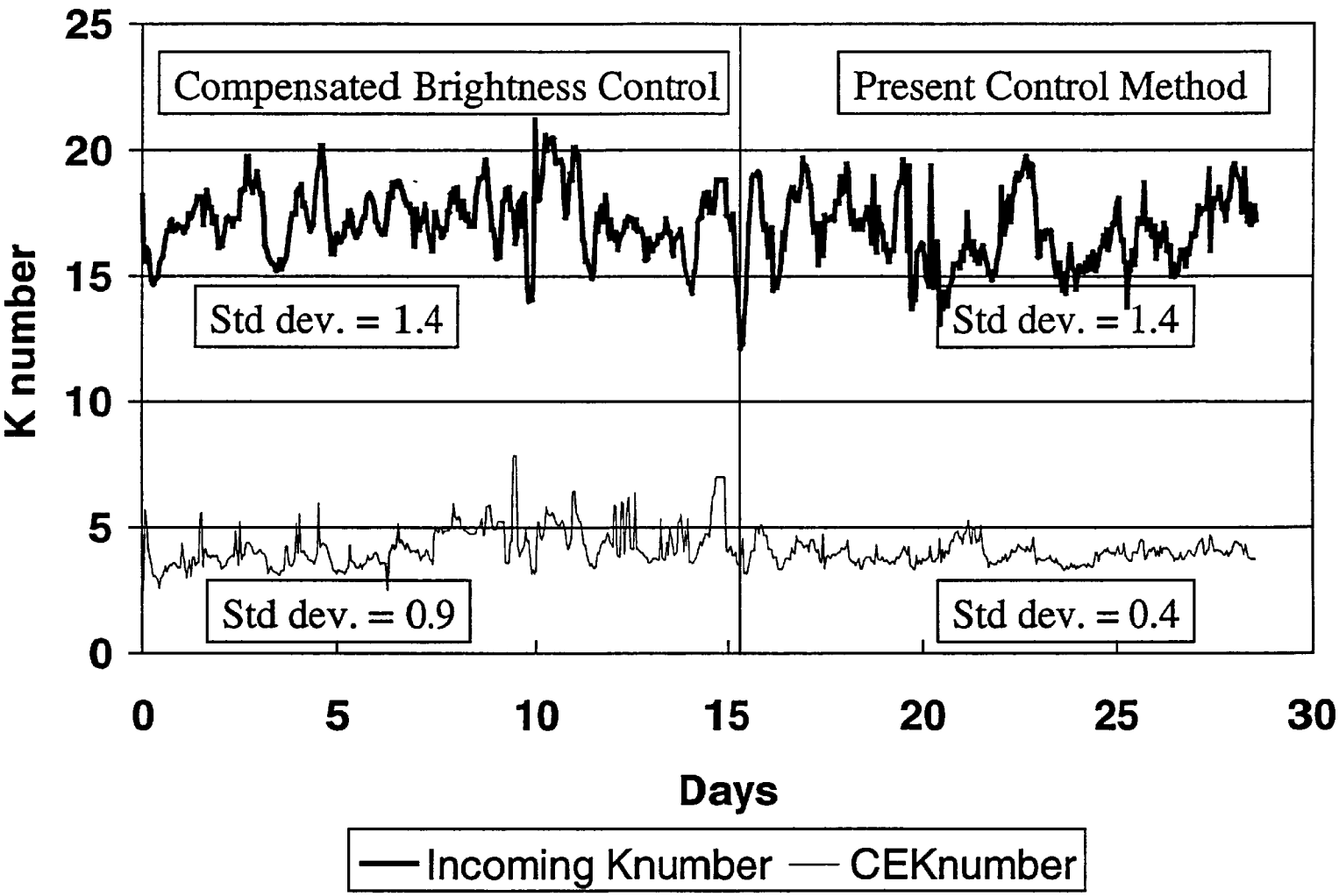

METHOD AND SYSTEM FOR CONTROLLING THE ADDITION OF BLEACHING REAGENTS TO OBTAIN A SUBSTANTIALLY CONSTANT PERCENTAGE OF PULP DELIGNIFICATION ACROSS THE FIRST BLEACHING/DELIGNIFYING STAGE

FIELD OF THE INVENTION

The present invention relates to a system and method for the controlled addition of bleaching/delignifying reagents for the delignification and/or bleaching of pulp, preferably kraft pulp, in the first bleaching/delignifying stage.

BACKGROUND OF THE INVENTION

In the pulp industry, the goal of the bleaching process is to increase pulp brightness by removing and/or modifying the light-absorbing lignin left in the pulp after the cooking and washing processes. This can be achieved by adding an appropriate amount of several reagents in sequential stages in a manner that preserves the pulp strength characteristics. The first bleaching/delignification stage is referred to as "C" when using 100% of chlorine, "C/D" when using a mixture of chlorine and chlorine dioxide, and "$D_{100}$" when using 100% of chlorine dioxide. In the first bleaching/delignification stage, chlorine and/or chlorine dioxide are used to delignify the pulp. The delignification stage is conventionally followed by an extraction stage to remove the alkali-soluble lignin. Oxygen and/or hydrogen peroxide may be added in the extraction stage to brighten the pulp. Subsequently, pulp brightness is increased by eliminating the chromophoric groups in the lignin.

Bleaching reagents like chlorine and/or chlorine dioxide represent a very large portion of the production cost of bleached pulp. It is not unusual to have an incomplete reaction, which causes unreacted bleaching reagents to remain in the slurry. They have to be recycled or they end up in the pulp mill effluent. The latter option is not preferred for obvious environmental reasons. It is therefore important, both from a point of view of cost and environment protection, to adequately monitor the amount of reagents added to the bleaching/delignification stage. Although this may seem trivial, it is in fact a strenuous task because of the high variations in the lignin content of the pulp entering the tower, and the varying residence time of the pulp therein during the bleaching stage.

The bleach plant is at the end of the pulping process and represents the last opportunity to improve pulp quality. Increased reagent cost, tighter customer's requirements and tougher environment regulations are all incentives for increasing bleach plant control.

There are many theories on how to control a bleaching stage. Pulp bleaching in the first chlorination stage is the result of two reactions, namely substitution and oxidation. Because the substitution reaction is much quicker than the oxidation reaction, early bleach plant control methods were based on measurement of either brightness or residual reagent concentrations shortly after injection of the bleaching/delignifying reagents and/or at the tower outlet.

To better appreciate the scope of the present invention, a brief review of known control methods is provided hereunder.

Control Strategies Based on the Measurement of Residual Reagent Concentrations 1. Measurement of residual reagent concentrations at the tower outlet In such a method, the addition of delignifying/bleaching reagents is based on the concentration of residual reagents measured in the pulp upon completion of the first delignification stage. Because of the variations in the properties of the pulp, and because of varying residence times, typically between 15 and 75 minutes, excess of bleaching reagents is required in the tower, resulting in unnecessarily high delignification costs and effluent loading by unused bleaching reagents.

2. Measurement of residual reagent concentrations shortly after injection

Here, delignifying/bleaching reagent addition is based on the concentration of residual reagents in the pulp suspension measured shortly after the delignification has begun. This method allows a quicker correction of the addition of delignifying/bleaching reagents than the first method, but fails to consider the variations of lignin content in the pulp and the varying delays between the injection point and the measurement point because of production changes.

3. Measurement of residual reagent concentrations both shortly after injection and at the tower outlet The set point for the residual reagent concentrations shortly after injection of delignifying/bleaching reagents is determined by the residual reagent concentrations measured at the tower outlet. This method is an improvement over the previous methods, but still does not properly accommodate for the variations in the pulp characteristics.

4. Combined measurements of the concentration of reagents consumed by the liquor prior to injection and of the residual reagents concentrations after a predetermined reaction time The set point for the reagents' addition is calculated from the combined measurements of the concentration of reagents consumed by the liquor prior to injection and of the residual reagents' concentrations after a predetermined reaction time. This approach allows a more accurate addition of delignification/bleaching reagents than in any of the previous methods. However, to operate efficiently, the temperature and residence time must remain constant during the delignification/bleaching process. Unfortunately, such requirements are generally not achieved in industrial practice.

5. Maintaining the relative consumption of delignification/bleaching reagents constant The relative chemical consumption of reagents is defined as the ratio between the residual reagent concentration measured after a given time and the initial reagent concentration added to the medium. The determination of the reagent concentration can be made a few minutes up to several hours after its injection as long as the reagent is not entirely consumed. This method requires extremely accurate determinations at two locations, and therefore measurements must be taken in a continuous manner. Normally, the delignification rate drops rapidly at the beginning of the reaction. Hence, the values measured will lie very close to one another in a magnitude that increases the accuracy requirement. The end result is that it is difficult to reach the precision required by this approach using known analytical techniques. The other disadvantage is that a change in production rate will change the time between the two measurements which will lead to a different relative consumption even under the same bleaching conditions.

Even under constant temperature and residence time conditions, the previous techniques tend to underchlorinate high kappa number pulp and overchlorinate low kappa number pulp. The methods suffer from the fact that the reagent residual concentration is correlated but not directly representative of the quality of the bleaching or delignifying or the pulp, which is measured by standard brightness and kappa tests. Moreover, only the fourth method makes it possible to take into account the reagent consumption by the reagent-consuming species present in the effluent liquor. The other methods seek to maintain constant residual reagent concentrations at the measuring location. This approach is doubtful because it may not be required to have constant residual reagent concentrations in order to obtain a uniform bleaching/delignification.

Control Strategies Based on the Measurement of Pulp Brightness

1. Measurement of pulp brightness at the tower outlet

This strategy uses only the pulp brightness measured at the tower outlet to determine the required amount of reagents. Such a method is rarely used and is inefficient because of the variations in the properties of the incoming pulp, the long residence time and the difficulty in accurately measuring brightness after the first delignification/bleaching stage.

2. Measurement of Pulp Brightness Shortly after the Reagent Injection

This method provides for a quicker correction of the addition of reagent than the first method. However, the change in brightness being very rapid during the first phase of the delignification/bleaching reaction, any change in production rate will affect the delay between the injection point and the location of the measuring brightness sensor, thus affecting the control performance.

3. Measurement of pulp brightness shortly after injection and at the tower outlet, or alternately after a predefined reaction time The set point for the brightness shortly after injection is determined from the downstream brightness measurement. This method is an improvement over the previous methods, but still does not properly accommodate for the frequent variations of the characteristics in the incoming pulp.

These control strategies work well only when the temperature and the residence time are constant. Nevertheless, even under these conditions, overchlorination of high kappa number pulp and underchlorination of low kappa number pulp is, again, generally observed. Furthermore, brightness measurement of low brightness pulp is inaccurate because the optical sensors are sensitive to pH, temperature, velocity, pulp consistency, mixing conditions, wood species and liquor carry-over.

Control Strategies Combining the Measurement of Residual Reagent Concentrations and Pulp Brightness 1. Compensated brightness control In view of the above, it became quite obvious that a combination of both pulp brightness and residual reagent concentrations measurements should be used to avoid over- or underchlorination. That lead to what is known in the art as compensated brightness control. An empirical equation using brightness, residual reagent concentrations, and sometimes production rate, temperature and pH, must be developed to calculate the compensated brightness which in turn is used to control the chlorine and/or chlorine dioxide addition rate. However, the compensated brightness is an artificial variable instead of a fundamental property of the pulp, and therefore, it cannot be measured as such during the process. Changing characteristics in the incoming pulp, like kappa, are correlated, but not always picked up by the compensated brightness signal.

Control Strategies Based on the Measurement of Pulp Kappa

1. Maintaining a constant Kappa factor

The kappa factor is defined as the percentage of active chlorine applied to the pulp divided by the kappa number of the pulp. Based on the lignin content of the pulp prior to the reagent injection and a desired kappa factor, the amount of reagents required is calculated. A constant kappa factor will neither produce a pulp with constant kappa number nor a constant degree of delignification at the outlet of the first or second tower. Furthermore, a constant kappa factor control will yield different results should changes occur in resident time and/or temperature.

2. Maintaining a constant CEKappa number

The kappa number of the pulp after the extraction stage (CEK) can be obtained from conventional on-line kappa analyzers or by a manual laboratory test. In this method, the addition of delignification/bleaching reagents is based on the measurement of the lignin content of the pulp after the extraction stage. The caustic concentration is usually ratioed to the bleaching reagent concentration. The major problem with such a method is that there is a long delay, typically between 75 and 150 minutes from the time the reagent is added in the first stage up to the measurement of the kappa number after the extraction stage.

In view of the above, it is therefore apparent that there is a great need to develop a method and system for the controlled addition of delignifying/bleaching reagents in the delignification and/or bleaching of pulp in the first delignification stage, so that the percentage of delignification of the pulp is substantially constant for any pulp across the stage. To be adopted and effectively implemented by the pulp industry, such a system should require limited capital investment and allow easy retrofitting on current plant installations with minimal training for operators.

SUMMARY OF THE INVENTION

In accordance with the present invention, there is now provided a method for obtaining a substantially constant percentage of delignification of pulp across the first bleaching/delignifying stage. More specifically, the method comprises the steps of:

i) providing a computer for acquiring data related to the properties of the pulp prior to its entrance in a bleaching tower, and data related to the conditions within the bleaching tower;

ii) defining a target percentage of delignification for the pulp, and providing the target percentage of delignification to the computer;

iii) processing the data of steps i) and ii) to obtain a bleaching/delignifying reagent flow rate required to obtain the target percentage of delignification of the pulp across the bleaching/delignifying stage;

iv) transmitting the bleaching/delignifying reagent flow rate obtained in step iii) to a DCS, the DCS being coupled to bleaching reagent injecting means adapted to inject the bleaching/delignifying reagent in the tower in an amount sufficient to obtain the target percentage of delignification for the pulp; and v) repeating steps i) to iv) continuously;

whereby a substantially constant percentage of delignification of the pulp is obtained across the bleaching/delignifying stage.

The present invention is also concerned with a system for obtaining a substantially constant percentage of delignification of pulp across the first bleaching/delignifying stage. More specifically, the system comprises:

a) a computer connected to a distributed control system (DCS) or a database, or both, for acquiring data related to pulp properties prior to its entrance in a bleaching tower, and data related to conditions within the bleaching tower;

b) processing means comprised in the computer to process the data acquired in step a) to determine a bleaching/delignifying reagent flow rate required to obtain the substantially constant percentage of delignification of the pulp across the first bleaching/delignifying stage; and c) transmitting means comprised in the computer for transmitting the bleaching/delignifying reagent flow rate required to obtain the substantially constant percentage of delignification of the pulp across the first bleaching/delignifying stage;

whereby the bleaching/delignifying reagent flow rate is controlled automatically by the DCS through information transmitted from said transmitting means.

IN THE DRAWINGS

FIG. 1 illustrates the model predictions and the experimental data at 50° C. for 3 different pulps bleached with different kappa factors; and FIG. 2 illustrates the incoming pulp kappa number and CEKappa number standard deviations obtained with a conventional compensated brightness control method and the present method.

DETAILED DESCRIPTION OF THE INVENTION

The present invention is concerned with an advanced bleach plant control system and method based on pulp tracking, kappa number, residual, brightness and the reaction kinetics during a bleaching/delignifying stage. The method and system are particularly advantageous in the first bleaching/delignifying stage of kraft pulps. Models have been developed and used to calculate the control moves from the predicted product properties and process characteristics. As it can be seen, controlled moves allow more effective reductions in variations and substantially improve process efficiency. The present system and method can be applied to C, D/C or $D_{100}$ stages, and the benefits thereof will become apparent in view of the following description.

Current compensated brightness control strategies use an indirect measurement of the incoming pulp characteristics and are sometimes unable to detect variations in the incoming pulp kappa number, thus ultimately not providing adequate control. For the bleaching/delignifying stage, the key variables that affect pulp bleaching are the kappa number of the pulp before the reagent addition; the amount of bleaching/delignifying reagent added; changes in washer carry-over; the residence time in the tower, which depends upon production rate; pulp consistency; pH and temperature. When the incoming pulp kappa number, production rate, and temperature vary, more or less reagents must be added to the pulp to achieve the target percentage of delignification, which is defined as the difference in kappa number of the pulp between the inlet and the outlet of the bleaching tower divided by the kappa number of the pulp at the tower inlet, multiplied by 100.

The present method has been developed based on mechanistic models that take into account the pulp flow hydrodynamic behaviour inside the tower and the kinetics of the delignification and bleaching reactions. These models are subsequently used to calculate the amount of reagents required, for example for $ClO_2$, from the operating conditions and target percentage of delignification.

Mechanistic Models

A. The chlorine dioxide delignification model

When developing a mechanistic model for the prediction of kappa number, brightness and residuals from operating conditions, one needs to understand the stoichiometry and the kinetic of the delignification/bleaching reactions. The accuracy of the kinetic model used in the present method and system is critical as the performance of the whole control system depends upon the model predictions.

Research in the area of bleaching reaction kinetics has not caught up with the rapid changes in recent years. Although many papers have been published on chlorine delignification and chlorine dioxide substitution, only a few are devoted to 100% chlorine dioxide delignification kinetics. To develop site specific models, pulp samples at different kappa numbers were gathered and experiments were performed at different chlorine dioxide charges and temperatures. From the analysis of the experimental data, a kinetic model structure similar to the one proposed in *Tappi J.,* 1975, 58(10), 141–145 was used to account for the fast and slow reactions, as well as the presence of unreactive lignin, also referred to in the art as floor lignin. The details of the experimental procedure and the kinetic model are found in *Canadian J. of Chemical Engineering,* 1997, 75(2), 23–30. From this kinetic model, a second model more suitable for the process control was derived in *Tappi J.,* 1997, 80(6), 145–153 and is presented below.

$$D\text{kappa}(t)=\text{Incoming pulp Kappa}-9-K_k(1-e^{-t/\tau})$$

$$D\text{brightness}(t)=\text{Incoming pulp Brightness}+8.5+1.66\,K_k(1-e^{-t/\tau})$$

$$ClO_2\ \text{Consumption}(t)=1.45+K_k/5.8(1-e^{-t/\tau})$$

A least square optimisation technique is used to estimate the static gain $K_k$ and the time constant $\tau$ as a function of temperature and kappa factor. The value of these parameters also depends on the wood species, and accordingly, they vary from one mill to the other. FIG. 1 shows the model predictions and the experimental data at 50° C. for 3 different pulps bleached with different kappa factors. As it can be seen, the model is validated by the experimental data obtained.

B. The hydrodynamic model

Once the delignification/bleaching reaction has been modelled, the next step is to quantify the amount of mixing taking place in the bleaching tower, as it will impact the conversion reaction. Tracer responses were performed using lithium chloride to study the pulp flow behaviour inside the $D_{100}$ tower in term of transport lag and mixing. The E-curves showed that the pulp flow in the towers deviated quite significantly from pure plug flow and that mixing was substantial. A plug-flow in series with a continuous stirred tank is therefore used to approximate the response signals of all key variables, such as reagent concentrations, consistency, kappa number and brightness. For example, in a $D_{100}$ tower operating at a pulp consistency of 3.2%, the percentage of mixing versus plug flow is 25% versus 75%.

Control Method for a $D_{100}$ Chlorination Stage

The consistency of the stock leaving the mix chest is controlled based on measurements from a conventional optical sensor. The proportional-integral-derivative (PID) flow control loop uses measurements from a magnetic flow meter following the dilution point. The production rate in the first stage is calculated from pulp flow rate and consistency measurements, and takes into account fibre shrinkage in each stage. The production control program provides a method of ramping the production rate in order to minimize its effect on pulp quality. A conventional kappa analyzer provides the incoming pulp kappa number to the first stage and kappa measurements after the second stage every 15 to 25 minutes.

The objective of the present control method is to obtain a substantially constant percentage of delignification of the pulp across the first bleaching/delignifying stage in order to efficiently distribute the work load of the bleaching reagent between the front-end and the back-end of the bleach plant. A computer program is used to read the process variables, i.e., pulp temperature, flow and consistency, kappa number and bleaching/delignifying reagent concentration measured from the various conventional sensors, as well as the target percentage of delignification, which can be specified manually by the bleach plant operator or automatically by an optimization program. The program then calculates the chlorine dioxide charge required to obtain the target percentage of delignification or kappa number reduction, from a kinetic model which takes into account the effect of residence time, temperature, and incoming pulp kappa number measured by a conventional kappa analyzer. The chlorine dioxide ($ClO_2$) flow can then easily be calculated from the $ClO_2$ charge, the $ClO_2$ concentration and the production rate. The $ClO_2$ concentration, which is a key variable when calculating the $ClO_2$ flow set point from the $ClO_2$ charge, is measured by a conventional $ClO_2$ strength sensor. A pulp tracking algorithm is used in conjunction with the kinetic model to calculate the kappa number prediction at the outlet of the tower should changes occur in the pulp flow or temperature as the pulp travels through the tower.

It should be noted, however, that various parameters may influence the target percentage of delignification. For example, the properties of the incoming pulp, the process conditions, the nature of the reagents used, the price of the reagents etc. When that happens, the target percentage of delignification can be modified at will by the operator or automatically through an optimization program, to obtain a pulp with the required quality at the tower outlet at competitive cost. This new target percentage of delignification will therefore be maintained constant in the system until it is necessary for the operator to change it again.

The control algorithm runs on a computer communicating with the mill distributed control system (DCS) and a database, such as conventional CIM/21™ or PI™ data management system, or both, thus allowing process values to be read by the program and targets to be returned to the DCS and local loops. Several features have been added to a) check for missing and erroneous data; b) detect bleach plant shutdowns and communication errors between the computer and the mill-wide information system; and c) to ensure smooth transfer when switching from manual to automatic. All the input variables to the program are preferably filtered to remove noise.

RESULTS

The present control system is implemented on a computer station linked to the mill DCS, and a graphic interface was designed for the operators. In addition, the kappa, brightness and residual at the outlet of $D_{100}$ are predicted from the pulp tracking model and displayed on the computer screen, providing "soft sensor" measurements of the pulp properties to the operators.

FIG. 2 demonstrates the benefits of the present system and method compared to the widely used compensated brightness control in the industry. The pulp kappa number measured after the second stage or CEKappa number standard deviation has been reduced by a factor of 2.4 or 57% and the system has been robust to process upsets.

EXAMPLE 1

Experiments were carried out in a bleach plant processing about 800 tons/day of pulp. Stock consistency and flow rate are controlled after the mix chest to maintain a target production rate. The first stage is operated at a temperature of 50° C., a pulp consistency of 3.2% and at 100% chlorine dioxide substitution. The residence time in the $D_{100}$ stage varies from 20 to 35 minutes depending on the production rate. This residence time is too short for the delignification reaction to be completed. The pulp slurry and chlorine dioxide, are mixed in a conventional Systematrix™ in-line mixer. The control system for the first stage includes local feedback loops for consistency and pH control.

After a few months of operation, the present control method and system have provided a much more stable bleaching operation. The standard deviation of the extracted CEKappa has been reduced by 57% from 0.90 to 0.39. The present inventions also provide significant savings in bleaching/delignifying reagents and reduce low brightness off-grades.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features herein before set forth, and as follows in the scope of the appended claims.

What is claimed is:

1. A system for obtaining a substantially constant percentage of delignification of pulp across a first bleaching/delignifying stage, the system comprising:

a) a computer coupled to a distributed control system (DCS) or a database, or both, for acquiring (i) data related to pulp properties prior to entrance of the pulp into a bleaching tower, where the pulp has a residence time between about 15 minutes and about 75 minutes, and (ii) data related to conditions within the bleaching tower;

b) processing means comprised in the computer to process the data acquired by the computer using (i) a kinetic model to predict reagent consumption, change in kappa number, and change in brightness to determine a bleaching/delignifying reagent flow rate required to obtain the substantially constant percentage of delignification of the pulp across the first bleaching/delignifying stage, and (ii) a pulp tracking algorithm to calculate changes in kappa number at the bleaching tower outlet based on pulp flow and temperature; and c) transmitting means comprised in the computer for transmitting the bleaching/delignifying reagent flow rate required to obtain the substantially constant percentage of delignification of the pulp across the first bleaching/delignifying stage;

whereby the bleaching/delignifying reagent flow rate is controlled automatically by the DCS through information transmitted from said transmitting means.

2. A system according to claim 1 wherein the data related to the properties of the pulp comprise pulp flow, pulp consistency, and kappa number, and the data related to the bleaching tower comprise tower temperature, bleaching reagent concentration, and residence time.

3. A system according to claim 1 wherein the bleaching/delignifying reagent is selected from the group consisting of chlorine dioxide, chlorine, and mixtures thereof.

4. A system according to claim 1 wherein the data related to the pulp and the data related to the bleaching conditions within the tower are filtered to remove noise.

5. A system according to claim 1 wherein the data related to the properties of the pulp does not include brightness.

6. A method for obtaining a substantially constant percentage of delignification of pulp across a first bleaching/delignifying stage, the method comprising the steps of:

i) providing a computer for acquiring (a) data related to the properties of the pulp prior to entrance of the pulp into a bleaching tower, where the pulp has a residence time between about 15 minutes and about 75 minutes, and (b) data related to the conditions within the bleaching tower;

ii) defining a target percentage of delignification for the pulp, and providing the target percentage of delignification to the computer;

iii) processing the data of steps i) and ii) suing (a) a kinetic model to predict reagent consumption, change in kappa number, and change in brightness to obtain a bleaching/delignifying reagent flow rate required to obtain the target percentage of delignification of the pulp across the bleaching/delignifying stage, and (b) a pulp tracking algorithm to calculate changes in kappa number at the bleaching tower outlet based on pulp flow and temperature;

iv) transmitting the bleaching/delignifying reagent flow rate obtained in step iii) to a DCS, the DCS being coupled to bleaching reagent injecting means adapted to inject the bleaching/delignifying reagent in the tower in an amount sufficient to obtain the target percentage of delignification for the pulp; and v) repeating steps i) to iv) continuously;

whereby a substantially constant percentage of delignification of the pulp is obtained across the bleaching/delignifying stage.

7. A method according to claim 6 wherein the data related to the properties of the pulp comprise pulp flow, pulp consistency, and kappa number, and the data related to the bleaching tower comprise tower temperature, bleaching reagent concentration, and residence time.

8. A method according to claim 6 wherein the bleaching/delignifying reagent is selected from the group consisting of chlorine dioxide, chlorine, and mixtures thereof.

9. A method according to claim 6 wherein the data related to the pulp and the data related to the bleaching conditions within the tower are filtered to remove noise.

10. A method according to claim 6 wherein the data related to the properties of the pulp does not include brightness.

* * * * *